US005333990A

United States Patent [19]

Foerster et al.

[11] Patent Number: 5,333,990

[45] Date of Patent: Aug. 2, 1994

[54] PERFORMANCE CHARACTERISTICS STABILIZATION IN A RADIAL COMPRESSOR

[75] Inventors: Arno Foerster, Worms; Berthold Engels, Weisenheim am Sand; Peter Hauck, Ludwigshafen, all of Fed. Rep. of Germany

[73] Assignee: Aktiengesellschaft Kuhnle, Kopp & Kausch, Frankental, Fed. Rep. of Germany

[21] Appl. No.: 940,892

[22] PCT Filed: Jul. 30, 1991

[86] PCT No.: PCT/EP91/01431

§ 371 Date: Oct. 28, 1992

§ 102(e) Date: Oct. 28, 1992

[87] PCT Pub. No.: WO92/03660

PCT Pub. Date: Mar. 5, 1992

[30] Foreign Application Priority Data

Aug. 28, 1990 [DE] Fed. Rep. of Germany ..... 4027174

[51] Int. Cl.[5] ..... F04D 29/44

[52] U.S. Cl. ..... 415/58.4; 415/914

[58] Field of Search ..... 415/11, 58.2, 58.3, 415/58.4, 914

[56] References Cited

U.S. PATENT DOCUMENTS

| | | | |
|---|---|---|---|
| Re. 32,462 | 7/1989 | Yoshinaga et al. | 415/914 |
| 4,930,978 | 6/1990 | Khanna et al. | 415/58.3 |
| 4,990,053 | 2/1991 | Rohne | 415/58.4 |
| 5,246,335 | 9/1993 | Mitsubori et al. | 415/58.3 |

*Primary Examiner*—Edward K. Look
*Assistant Examiner*—Mark Sgantzos
*Attorney, Agent, or Firm*—Klaus J. Bach

[57] ABSTRACT

As a device for stabilizing the performance characteristics, a radial compressor comprises a circulation chamber (31) which makes pressure equalization between the impeller and the intake region possible. The intake region has an intake ring (10) which makes it possible to influence the flow in the intake region so that the performance characteristics be stabilized without substantial losses. The compressor may be adapted to customer's requirements by changing the intake ring.

15 Claims, 6 Drawing Sheets

PERFORMANCE CHARACTERISTICS STABILIZATION IN A RADIAL COMPRESSOR

BACKGROUND OF THE INVENTION

The invention relates to performance characteristics stabilization for a radial compressor.

The trend in the development of charged engines is today towards higher medium pressures even at low engine speeds. When using present-day conventional compressors the engine operating range comes very close to the surge line and moves in the noise margin partially preceding the surge line.

To improve the capability of controlling such motors, compressors ape necessary having a characteristic exhibiting a wide performance range and wide range of high efficiency.

To meet the aforementioned requirements with existing hardware, it is possible to use range-stabilizing (RS) steps in the inlet passage of the compressor which would be very effective.

Such performance characteristic stabilizing features in the form of venting chambers have been known for a long time. They are effective in operating ranges in which the flow angle of attack on the impeller wheel is not correct. The performance characteristic stabilization permits in such critical operating points a stabilization of the performance characteristic by compensating for such disturbances by the buffer volume in the venting space, If the disturbance is more pronounced, a circulation occurs between the annular slots and the preventing space. In the region of the surge line the impeller wheel is subjected to flow with increasingly smaller angle of attack and in addition the pressure in the impeller wheel rises. As a result, air mass is conveyed back to the compressor inlet. At the impeller inlet edge more air is sucked in than the compressor as a whole conveys. As a result the angle of attack for this operating point is improved and the surge line shifted to smaller flow rates. The choke margin is caused by reaching the velocity of sound at the impeller inlet edge. There, a lower pressure is generated so that, via the bypass conduit, air is conveyed into the impeller wheel, whereby the choke margin is shifted to the right. In between, the performance characteristics stabilization arrangement is more or less ineffective. With ideal attack and matching it is fully ineffective.

The technique of compensating the pressure by bypass conduits which are connected to various axial regions and via which a pressure equalization can take place is known in particular from DE-PS 1,428,077. The technique has been progressively further developed as explained in a summary article by H. D. Henssler (Kuhnle, Kopp & Kausch, special print in VGB Kraftwerkstechnik, 57th edition, no. 3,1977).

Modern means for performance characteristics stabilization are known from EP-A 348674, EP-B 229519 and GB-OS 2,220,447. EP-B 229519 and GB-OS 2,220,447 disclose a bypass conduit leading directly from the gas intake to behind the leading edge of the impeller. The through the venting space is determined by the pressure difference in front of the impeller leading edge via an opening to the venting space, which hereinafter is referred to as opening 1, or from the venting space to the pressure in an opening at the impeller wheel, referred to hereinafter as opening 2.

A disadvantage is that the conditions in the venting space do not correspond to the conditions in the gas intake directly in Front of the impeller leading edge. For adjustment only the groove can be used as essential control point. Thus, a wide groove could appreciably shift the choke margin but in the region of the optimum this would considerably impair the efficiency and consequently the limit of such a design would be reached with the tolerability of the loss in efficiency.

These negative properties are avoided in EP-A 348674 in that both the inlet and the outlet lie almost perpendicular to the main Flow. The bypass conduit is thus not directly attacked. This results in a bypass flow which is generated by the pressure differences at the inlet and outlet of the bypass conduit.

The disadvantage of this construction is due to the fact that both sides of the bypass conduit lie in front of the impeller wheel. This means that the pressure difference at the bypass conduit is in any case very small and consequently this design is effective only when extreme pressure gradients occur in front of the impeller wheel. It is however desirable For the stabilization to start much earlier because the characteristic is then broadened in the range of high delivered volumes as well. For the normal operating point of an engine this means a better efficiency at lower speed level or greater reserves in the higher speed range.

A Further disadvantage of known designs resides in that the stabilizing means must be adapted to the type of compressor. Differences in the compressor blade design, contour variations and resulting different positions and intensities of disturbance or surge field at did not hitherto make it possible to give clear technical guidelines for designing a stabilizing means. Nor was hitherto possible to predict reliably whether a stable range could be achieved at a 11, and which stabilizing measures, in given compressor, in particular in a radial compressor, would be effective. With the present state of the art it would be extremely desirable if adaptation could be achieved by varying a minimum number of parameters.

These disadvantages lead to the object of the invention, that is, to provide a performance characteristics stabilization for radial compressors which permits a widening of the range without losses of efficiency.

SUMMARY OF THE INVENTION

Based on the means for performance characteristics stabilization of the type mentioned at the beginning, this problem is solved by a performance range stabilization.

The flow passes through the venting space serving as bypass conduit in the inlet region practically perpendicularly to the main flow at the wall so that additional eddies at said opening and the disadvantages involved are minimized. Due to the inlet ring this region is more strongly coupled to the state of the main flow directly in front of the impeller leading edge. The other end of the venting space is in communication with the impeller behind the impeller leading edge. The other end of the venting space is in communication with the impeller behind the impeller leading edge. This means that the performance characteristics stabilization operates at higher pressure difference and thus reacts substantially more sensitively to pressure changes between the inlet and outlet of the venting space than in a design according to EP-OS 0348674. The control effect is more pronounced. The utilization of large pressure differences by the flow connection to the impeller wheel is possible in this design. With stable operating conditions the invention makes it possible for a pressure difference of zero to be actually maintained at the venting space in the optimum operating range so that the venting space then has no effect and no losses of efficiency occur at this operating range.

In accordance with the above observations, the arrangement according to the invention provides a compressor which can be adapted to new conditions by optimizing the inlet area. For this purpose an inlet ring is provided which, via changes the flow behavior in the inlet area, varies the pressure difference in the venting space. Consequently, a simple optimizing of the performance characteristics stabilization for particular applications is possible., i.e., with the size of the inlet ring internal diameter the conditions in the vent space can be adjusted. With progressively smaller inlet diameters the conditions in the venting space becomes more closely adapted to the flow conditions or the flow pressure in front of the impeller leading edge.

Advantageous and expedient further embodiments of the invention are set forth in the subclaims.

DESCRIPTION OF PREFERRED EMBODIMENTS

Figure 1:
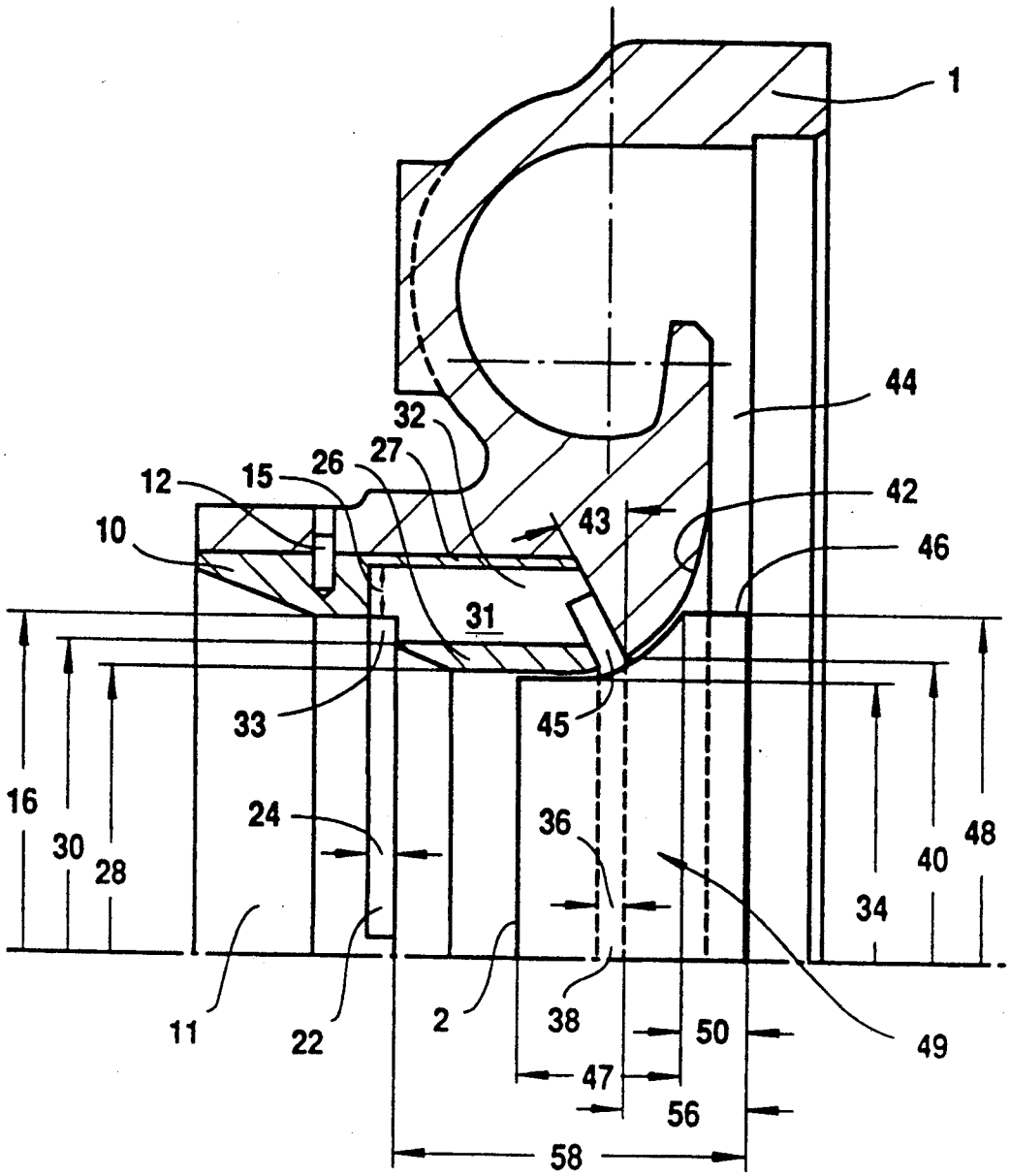
FIG. 1 shows a partial section through a radial compressor with performance characteristics stabilization.

The radial compressor illustrated in FIG. 1 in partial section consists of a compressor housing 1 having an impeller wheel 49 which conveys the medium to be compressed in FIG. 1 from the left to the right. The main flow enters from the inlet area 11, in which an inlet ring 10 provided partially with a conical contour is arranged into the impeller wheel 49 and flows from the impeller discharge edge 46 into the diffuser section 44.

In the housing wall a bypass passage with a venting space 31 is disposed, the latter being connected via an inlet groove 22 to the inlet area and opening via an annular slot 38 in the region of the impeller contour into the main flow. The inlet groove 22 terminates the inlet section and is disposed with its full opening width 24 in front of the impeller leading edge 2. The depth of the groove extends in the radial direction up to the inner diameter 16 of the inlet ring 10 and is divided by connecting uebs 32 extending from the diameter 16 of the inlet passage 11 to the housing inner surface.

The contour ring 26 extends from the inlet groove 22 up to the annular slot 38. The impeller leading edge 2 is disposed in an intermediate axial position of the contour ring. The inner diameter 28 of the contour ring corresponds to that of the impeller wheel diameter, leaving a necessary running clearance. The outer diameter of the contour ring 30 may be greater or smaller than or equal to the diameter 16. In the present embodiment it is made smaller. The contour ring is held centrally within the housing by the uebs 32. The webs are integrally cast on the compressor housing 1 or milled into the latter. The compressor housing 1 and inlet ring 10 may also be made from one piece.

In another embodiment the uebs 32 may also be made integrally with the contour ring 26. Furthermore, the contour ring 26 may also form an assembly unit together with the webs 32 and a further outer ring 27. This is particularly advantageous when the unit is made from plastic.

The contour ring 26 has an inlet cone at the internal diameter. The latter is chosen so that the diameter 28 is cylindrical in front of the impeller leading edge 2. The form of the contour ring 26 in the radial direction is made up of the form of the inlet groove 22 and the annular slot 38, The annular slot 38 is disposed between the contour ring 26 and the area 42 which corresponds in its form to the outer contour of the impeller wheel up to the diffusor section 44. The diameter 40 of the diffusor-side lead edge is greater than the diameter 28 of the inlet-side lead edge, The annular slot is arranged in the radial direction at an attack angle 43 between 20° and 30°. Usually, the attack angle is determined by a line extending perpendicularly to the tangent at the inner housing contour corresponding to the outer contour the impeller wheel.

The lead edges of the annular groove 38 can be rounded with a radius of 0 to 4 mm. This radius reduces the noise development caused by sharp edges. The radius is the same at the two lead edges.

Figure 5:
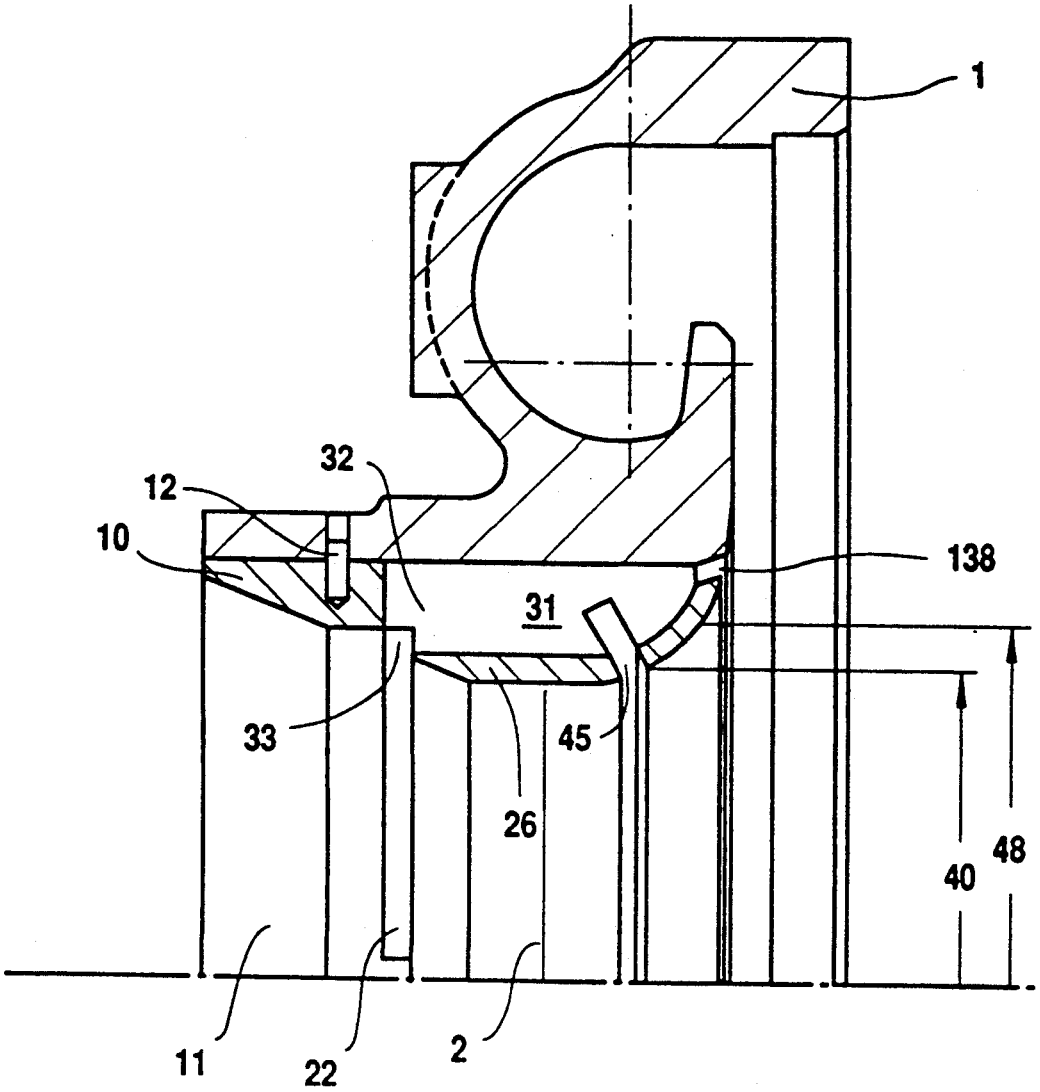
FIG. 5 shows a partial section through an embodiment provided additionally with an annular slot.

In the area 42 between the annular slot 38 and the diffusor section 44 a further annular slot 138 (diffuser slot) may be arranged. In FIG. 5 such an embodiment is illustrated. The width or this annular slot 138 is substantially smaller than the width 36 of the annular slot The performance characteristics stabilization is based on the pressure equalization via the venting space 31 which is formed by the inlet ring 10, the compressor housing 1 and the contour ring 26 and is in communication with the main flow via the connection openings 33 and stabilization openings 45 formed by the slots 22 and 38.

The inlet ring defines a limit for the venting space by a section 15 at the inlet side. The conical inlet ring 10 causes acceleration of the main flow in the direction of the impeller inlet.

The flow along the wall at the inlet ring changes conditions which via the annular slot 22 also changes the conditions in the venting space 31. The pressures at the connecting openings 33 and 45 may be fixed by the dimensioning or the slots 22 and 38 and the corresponding flow conditions. In addition, the performance characteristics stabilization arrangement must be adapted to the compressor type, with the position or the annular slot over the impeller contour, the width thereof and the inclined position as well as the volumes of the venting chambers, the configuration or the inlet and the position of the inlet groove defining the characteristic of the speed lines. When the pressure difference is fixed to zero for the design operating range, the venting space is without effect. In this range, the performance or the centrifugal compressor is not affected, i.e., no efficiency losses occur.

However, if pressure deviations occur in contrast to such an ideal case, pressure equalization can take place via the venting space. This results in a performance characteristics stabilization to the left or the optimum and an increase of the flow range to the right of the optimum, providing altogether for a wider operating range.

Since the mode of operation or the performance characteristics stabilization depends substantially on the flow conditions in the inlet passage, simple optimizing is possible by replacing the inlet ring 10 which is mounted with mounting pins 12 and, with an appropriate mounting arrangement can easily be replaced.

In addition to the central mounting, the webs 32 holding the contour ring 26 perform the task of stabilizing the flow in the axial direction.

Figure 2:
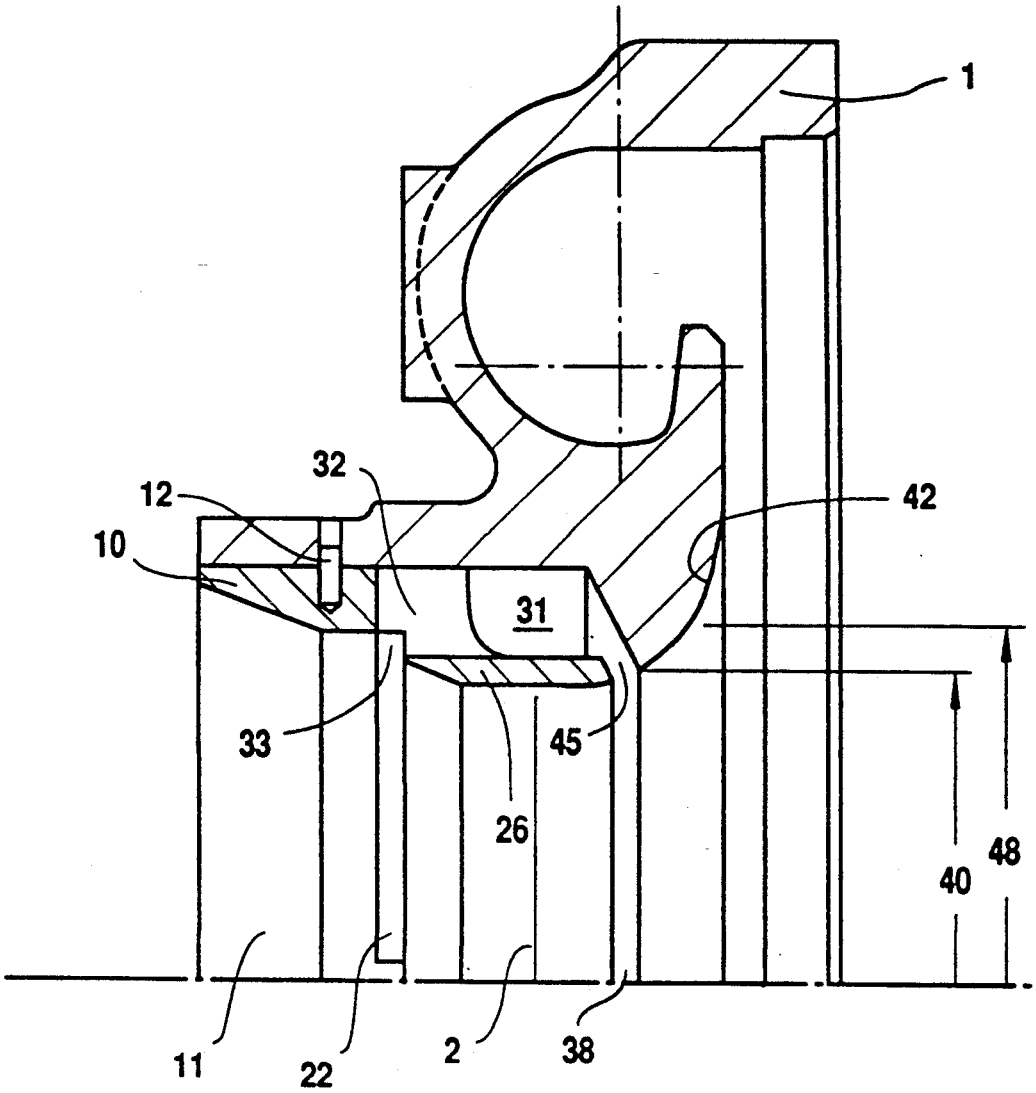
FIG. 2 shows a partial section through a radial compressor with a further performance characteristics stabilization.

In large compressors, in particular in conjunction with large hub ratios, the relatively wide webs, cause a pronounced wake flow, in particular in a flow from the opening 33 to the opening 45. The result is a significantly higher and louder noise pattern. An appreciable improvement in the noise pattern is achieved in such cases by shortening the webs in the venting space (FIG. 2). The flow is then given more distance breaking down the wake of the webs.

To avoid these disadvantages a construction according to FIG. 2 is preferred. The webs no longer contact the grooves and the web itself is rounded at the diffusor end.

Figure 3:
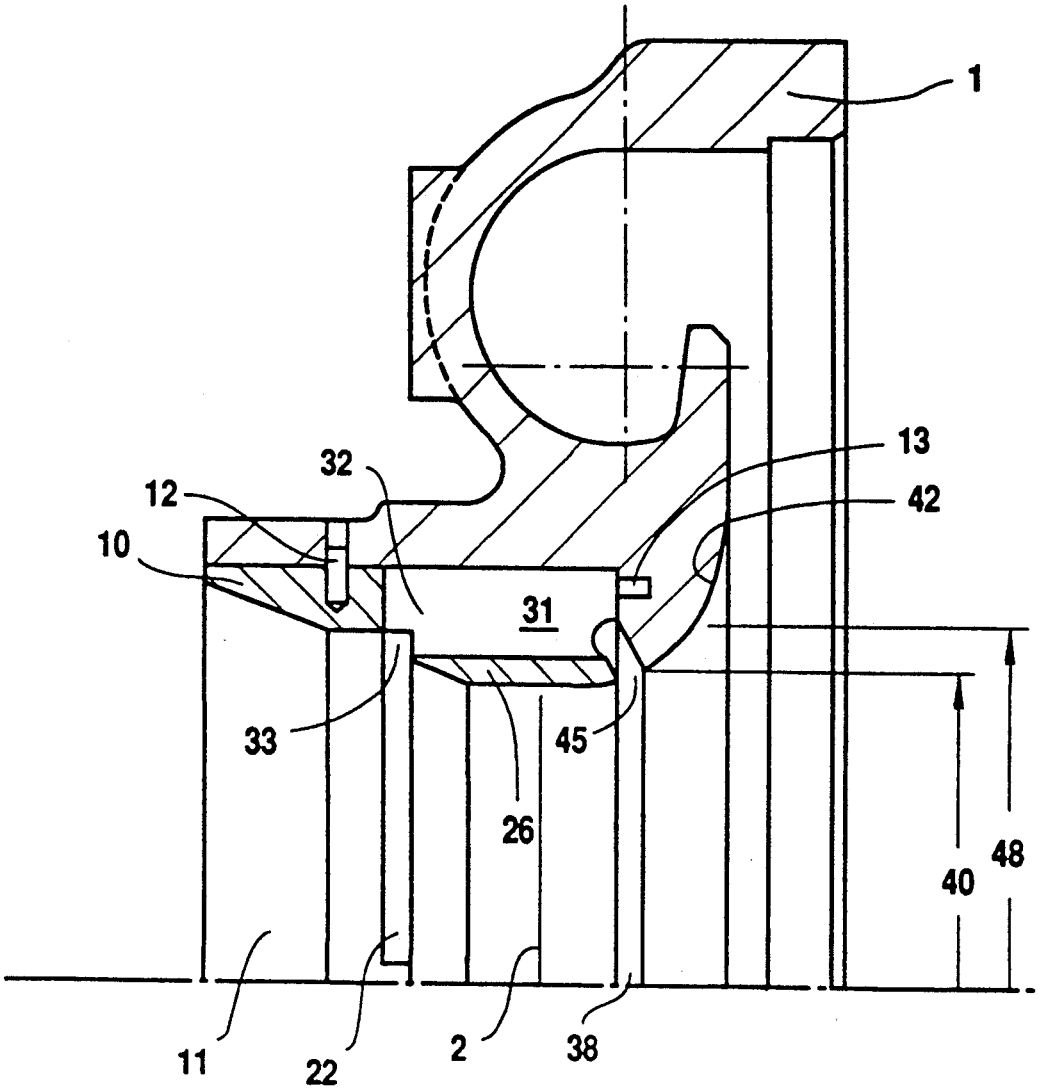
FIG. 3 shows a partial section through a radial compressor with another modified design configuration of the performance characteristics stabilization arrangement.

Another embodiment of the invention is illustrated in FIG. 3. In contrast to FIG. 1, here the annular slot 38 does not project far into the venting space 31. The webs 32 are rounded towards the opening of the annular slot 38. Compared with the embodiment according to FIG. 1, in which the ideal configuration of an annular slot at an angle of attack 43 is shown, the slot has a smaller depth to facilitate assembly in series production. On inserting the contour ring 26, a mounting pin 13 fitting into a bore in the housing is used to secure it against rotation. The inlet into the venting space at the opening 45 is bevelled as indicated before. Towards the area 42 a radial engagement surface is formed which facilitates assembly of the contour ring. The pin 13 secures against rotation.

Figure 4:
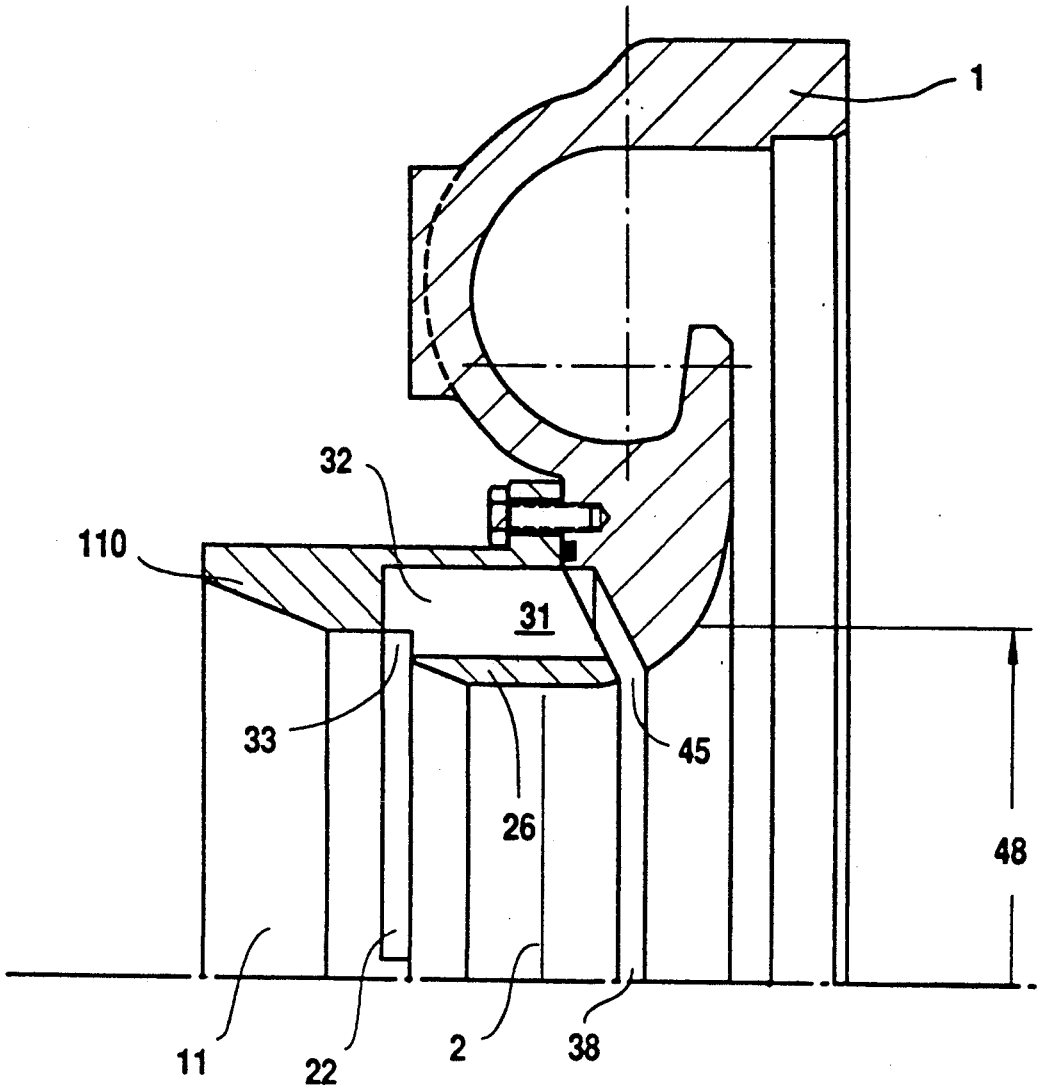
FIG. 4 shows a further partial section of another embodiment.

In the examples of FIGS. 1 to 3, the inlet ring 10 is fitted into the inlet passage and secured by pins 12. Another embodiment is provided by the design according to FIG. 4. Here, the insert 110 is bolted directly to the housing and determines the outer diameter of the venting space 31. This is a further design possibility permitting adaptation of the compressor to the customer's wishes.

FIG. 5 shows a further embodiment. The venting space extends here almost up to the impeller trailing edge. For better adjustment of the performance characteristics stabilization three annular slots 22, 45 and 38 are provided in this case.

Figure 6:
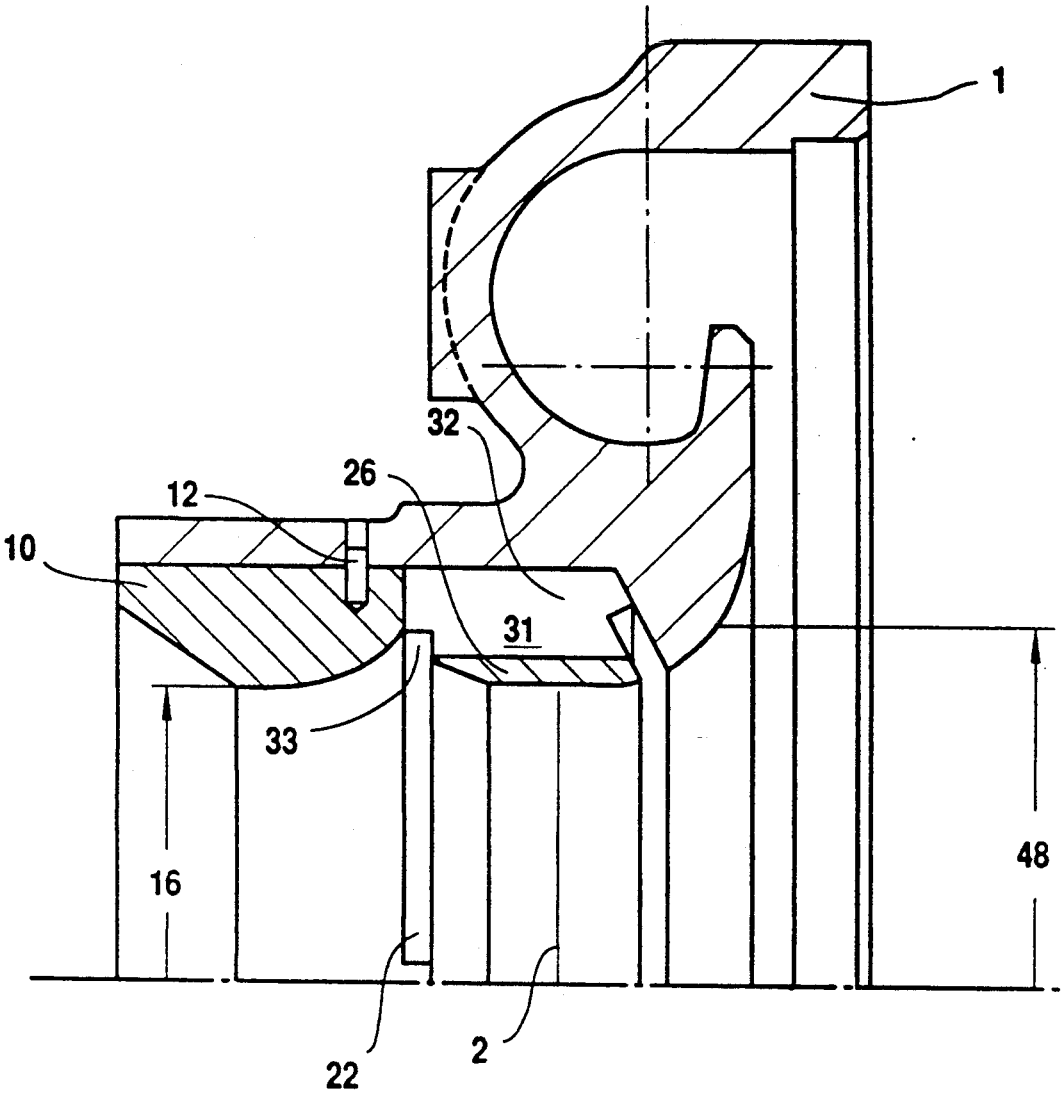
FIG. 6 shows a partial section through an embodiment having a modified inlet ring.

In FIG. 6 an example of an embodiment is shown in which the diameter 16 of the inlet section is smaller than the contour ring. Such an embodiment has the advantage of a higher acceleration in the inlet passage and an improvement of the pressure difference ratios in the region of the opening 33 and in the venting space.

As has been explained above, the mode of operation of the performance characteristics stabilization arrangement depends substantially on the flow conditions at the slots 22 and 38 and in the venting space 31 itself. The flow conditions at the connecting openings are influenced substantially by the slots.

The desired characteristic is obtained by adjusting the entire system wherein according to the invention maintaining the efficiency level is of greater importance. Adjusting the performance characteristics stabilization arrangement so as to move the choke margin outwardly provides the best results from this point of view. Since the operating range of a compressor of a particular size with regard to the surge line is set by variation of the hub ratio or the compressor contour, and since for a particular compressor size the same venting means is to be used, the dimensioning of the RS measures are expediently adapted to the exit area or the impeller wheel.

For the adjustment generally the following points have to be taken into consideration:

1) The dimensioning of the area of the venting space 31.

2) The conditions in said venting space are to be additionally adjusted by an inlet ring 10 which more or less covers the venting space in the suction area.

3) The area and position of the annular slot 38 above the impeller.

4) The angle of attack 43 of the annular slot 38 above the impeller wheel.

Hereinafter, design features optimizing these parameters are given.

The diameter 16 of the inlet is 0.64 to 1.2 times the impeller trailing edge diameter 48, the preferred range being between 0.7 and 0.9.

The width 36 of the annular slot 38 is 0.55 to 0.7 times the impeller trailing edge width 50.

If additional annular slots are present, their widths should not be more than a quarter of the impeller trailing edge width 50.

The axial position, defined by the distance 56 between annular slot 38 and rear end of, the impeller wheel 49, is 0.15 to 0.3 times the impeller trailing edge diameter 48.

The axial position of, the inlet groove 22 is at a distance 58 from the rear end of, the impeller wheel said distance 58 being 0.36 to 0.6 times the impeller trailing edge diameter 48.

The width 24 of the inlet groove 22 is 1 to 1.1 times the width 36 of the annular slot 38.

The ratio of the cross-sectional area of the venting space 31 in the radial direction to the area of the annular slot 38 is between 3.5 to 4.5 times the area related to the diameter 40 of the area of, the annular slot.

The ratio of the inner diameter 30 of the venting space 31 is about 0.8 times the impeller trailing edge diameter 48.

The width 36 of the annular slot 38 is 0.03 to 0.05 times the impeller trailing edge diameter 48.

The ratio of the area of, the annular slot 38 to the square of the impeller trailing edge diameter 48 is 0.106 to 0.151 times the hub ratio, the hub ratio being governed by the ratio of the impeller wheel diameter in the inlet 34 to that of the outlet 48 and lying for example between 0.64 to 0.74.

The volume of the venting space 31 is between 0.06 to 0.23 times the third power of the impeller trailing edge diameter 48.

The narrow intervals of these ratios clearly shout to which parameters the greater attention must be given in the design of a centrifugal compressor with performance characteristics stabilization. The adjustment ranges as given indicate in which range the specified values must be selected. The teaching contained in the particular values makes it possible to provide for a performance characteristics stabilization for radial compressors which does not impair the efficiency and broadens the range.

What is claimed is:

1. Arrangement for performance characteristics stabilization in a radial compressor comprising a housing with an inlet area, an outlet area and an impeller disposed between the inlet and outlet areas and capable of transporting, upon rotation, a medium from the inlet area to the outlet area, said impeller having a contour which changes in axial direction from a diameter at its inlet to a diameter at its outlet in accordance with the profile of a contour wall of the surrounding housing, said arrangement for performance characteristics stabilization comprising a contour ring disposed adjacent the impeller and defining an inlet passage for guiding a main medium flow from said inlet area to said impeller, a venting space surrounding said contour ring and extending from said inlet area to said contour wall, said venting space being in communication with said inlet passage at said inlet area via an inlet communication opening and at the impeller inlet via a stabilization opening disposed intermediate the impeller inlet and the impeller outlet, and an inlet ring exchangeably mounted in said inlet area adjacent said venting space and having a conical inlet end for constricting said main medium flow to said contour ring ahead of said impeller, said inlet ring having an inner radial end wall limiting said venting space and defining said venting space inlet communication opening for controlling medium conditions in said venting space.

2. Arrangement for performance characteristic stabilization in a radial compressor according to claim 1, wherein the inlet ring is exchangeable for inlet rings with dimensions defining other predetermined communication openings.

3. Arrangement for performance characteristic stabilization in a radial compressor according to claim 1, wherein the diameter of the inlet passage is 0.64 to 1.2 times the impeller trailing edge diameter and the preferred range lies between 0.7 to 0.9.

4. Arrangement for performance characteristic stabilization in a radial compressor according to claim 1, wherein said stabilization opening is an annular slot conducting the flow to the impeller wheel and is arranged at an angle of attach in the radial direction between 20° and 30°.

5. Arrangement for performance characteristic stabilization in a radial compressor according to claim 4, wherein the width of the annular slot is 0.55 to 0.7 times the impeller trailing edge width.

6. Arrangement for performance characteristic stabilization in a radial compressor according to claim 4, wherein at least one annular diffuser slot is formed at the discharge end of said impeller which slot has a width corresponding to a quarter of the impeller trailing edge width.

7. Arrangement for performance characteristic stabilization in a radial compressor according to claim 4, wherein the axial position defined by the distance of the annular stabilizer slot from the trailing edge of the impeller is 0.15 to 0.3 times the impeller trailing edge diameter.

8. Arrangement for performance characteristic stabilization in a radial compressor according to claim 6, wherein the position of the inlet communication opening is at a distance from the trailing end of the impeller wheel which distance is 0.36 to 0.6 times the impeller trailing edge diameter.

9. Arrangement for performance characteristic stabilization in a radial compressor according to claim 4, wherein said inlet communication opening is an annular groove, the ratio of the width of the inlet communication groove to the width of the stabilization slot being 1 to 1.1.

10. Arrangement for performance characteristic stabilization in a radial compressor according to claim 1, wherein the ratio of the cross-sectional area of the venting space to the radial area of the stabilization opening is between 3.5 to 4.5.

11. Arrangement for performance characteristic stabilization in a radial compressor according to claim 1, wherein the of the inner diameter of the venting space is approximately 0.8 times the impeller trailing edge diameter.

12. Arrangement for performance characteristic stabilization in a radial compressor according to claim 1, wherein the width of the annular stabilization slot is 0.03 to 0.05 times the impeller trailing edge diameter.

13. Arrangement for performance characteristic stabilization in a radial compressor according to claim 1 wherein the ratio of the area of the stabilization opening to the square of the impeller trailing edge diameter is between 0.106 to 0.151 of hub ratio, the hub ratio being defined by the ratio of the impeller wheel diameter at the inlet to that of the impeller trailing edge.

14. Arrangement for performance characteristic stabilization in a radial compressor according to claim 1, wherein the volume of the venting space is between 0.06 to 0.23 times the third power of the impeller trailing edge diameter.

15. Arrangement for performance characteristic stabilization in a radial compressor according to claim 1, wherein said contour ring is supported in said housing by webs and the end faces of the webs carrying the contour ring are rounded.

* * * * *